US009538306B2

(12) United States Patent
Nakamura

(10) Patent No.: US 9,538,306 B2
(45) Date of Patent: Jan. 3, 2017

(54) SURROUND COMPONENT GENERATOR

(71) Applicant: PANASONIC CORPORATION, Kadoma-shi, Osaka (JP)

(72) Inventor: Kazuhiro Nakamura, Kanagawa (JP)

(73) Assignee: PANASONIC INTELLECTUAL PROPERTY MANAGEMENT CO., LTD., Osaka-shi (JP)

( * ) Notice: Subject to any disclaimer, the term of this patent is extended or adjusted under 35 U.S.C. 154(b) by 158 days.

(21) Appl. No.: 14/373,820

(22) PCT Filed: Jan. 31, 2013

(86) PCT No.: PCT/JP2013/052144

§ 371 (c)(1),
(2) Date: Jul. 22, 2014

(87) PCT Pub. No.: WO2013/115297

PCT Pub. Date: Aug. 8, 2013

(65) Prior Publication Data

US 2015/0304788 A1 Oct. 22, 2015

(30) Foreign Application Priority Data

Feb. 3, 2012 (JP) ..... 2012-021921

(51) Int. Cl.
*H04S 1/00* (2006.01)

(52) U.S. Cl.
CPC ..... *H04S 1/00* (2013.01); *H04S 1/002* (2013.01); *H04S 2420/07* (2013.01)

(58) Field of Classification Search
CPC ..... H04S 1/00; H04S 1/002; H04S 2420/07
(Continued)

(56) References Cited

U.S. PATENT DOCUMENTS 8,213,648 B2 7/2012 Kimijima
2008/0019533 A1* 1/2008 Noguchi ..... H04S 5/00 381/17

(Continued)

FOREIGN PATENT DOCUMENTS

CN 101039536 A 9/2007
EP 1 610 588 A2 12/2005

(Continued)

OTHER PUBLICATIONS

International Search Report dated Feb. 26, 2013, issued in corresponding application No. PCT/JP2013/052144.

(Continued)

*Primary Examiner* — David Ton
(74) *Attorney, Agent, or Firm* — Westerman, Hattori, Daniels & Adrian, LLP

(57) ABSTRACT

Provided is a surround component generation device capable of generating surround components for multichannel reproduction based on two-channel audio signals with a small amount of arithmetic operation. The surround component generation device includes: multipliers for changing amplitudes of audio input signals; subtractors for subtracting outputs of the multipliers from the input signals; coefficient updaters for updating coefficients of the multipliers; subtractors for generating surround components based on the input signals and the output signals of the multipliers; output switches for switching and outputting the output signals of the subtractors; and output switching controllers for controlling the output switches. Each of the coefficient updaters updates the coefficient of the multiplier based on the output of the subtractor, and each of the output switching controllers switches the output switch based on the coefficient updated by the coefficient updater.

5 Claims, 5 Drawing Sheets

(58) Field of Classification Search
USPC ..... 381/1, 17–19, 307
See application file for complete search history.

(56) References Cited

U.S. PATENT DOCUMENTS

| | | | | |
|---|---|---|---|---|
| 2008/0226085 | A1* | 9/2008 | Takashima | H04S 5/00 381/18 |
| 2012/0045065 | A1* | 2/2012 | Ishihara | H04S 5/005 381/17 |
| 2012/0170756 | A1* | 7/2012 | Kraemer | H04S 7/302 381/17 |
| 2013/0170648 | A1* | 7/2013 | Iseki | H04S 5/02 381/17 |

FOREIGN PATENT DOCUMENTS

| | | | |
|---|---|---|---|
| JP | 57-070000 | A | 4/1982 |
| JP | 05-236599 | A | 9/1993 |
| JP | 3682032 | B2 | 8/2005 |
| JP | 2006-005414 | A | 1/2006 |
| JP | 2008-187547 | A | 8/2008 |
| JP | 2011-151633 | A | 8/2011 |

OTHER PUBLICATIONS

Avendano et al., "Ambience Extraction and Synthesis from Stereo Signals for Multi-Channel Audio Up-Mix", 2002 IEEE International Conference on Acoustics, Speech, and Signal Processing. Proceedings. (ICASSP), Orlando, FL, May 13-17, 2002, New York, NY: IEEE, US, May 13, 2002, vol. 2, pp. II-1957-1960, Cited in Extended European Search Report dated May 20, 2015.

Short, "Circuit Ideas", Wireless world, IPC Business Press Ltd., Jun. 1, 1973, vol. 79, No. 1452, Haywards Heath, GB, pp. 284, Cited in Extended European Search Report dated May 20, 2015.

Extended European Search Report dated May 20, 2015, issued in corresponding Patent Application No. 13743492.4 (9 pages).

English translation of Office Action dated Nov. 27, 2015, issued in counterpart Chinese Application No. 201380007449.4 (2 pages).

* cited by examiner

SURROUND COMPONENT GENERATOR

TECHNICAL FIELD

The present invention relates to a surround component generation device for generating surround signals for multichannel reproduction based on two-channel audio signals.

BACKGROUND ART

As a related-art surround component generation device, there has been known a stereo reproduction device having two signals of L and R signals as its signal source. The stereo reproduction device emits an L signal from a first speaker and an R signal from a second speaker in proportion to a degree of mismatch between the L and R signals, emits an (L+R) signal from a third speaker or an imaginary sound source speaker arranged between the first speaker and the second speaker in proportion to a degree of match between the L and R signals, and, to acquire the degree of mismatch and the degree of match, calculates a difference or correlation coefficient between the L and R signals or both thereof (see, for example, Patent Literature 1).

Further, as another related-art surround component generation device, there has been known a device including: correlation coefficient arithmetic means for inputting left and right signals L and R of an acoustic component signal to calculate a correlation coefficient K based on the left and right signals L and R; delay means for outputting left and right signals L' and R', which have been delayed by a period of time required for arithmetic processing of the correlation coefficient arithmetic means; left and right component signal arithmetic calculation means for performing arithmetic processing of L'(1−K) and R'(1−K) based on the delayed left and right signals L' and R' and the correlation coefficient K to calculate left and right component signals L"=L'−KL' and R"=R'−KR'; center component signal arithmetic means for performing arithmetic processing of K(0.5L'+0.5R') based on the delayed left and right signals L' and R' and the correlation coefficient K to calculate a center component signal C"=K(0.5L'+0.5R'); left and right reproduction output means, which are arranged on the front side of a listener, for reproducing and outputting the left and right component signals L" and R", respectively; and center reproduction output means, which is arranged between the left and right speakers, for reproducing and outputting the center component signal C" (see, for example, Patent Literature 2).

Further, as still another related-art surround component generation device, there has been known an audio device for generating surround signals for a plurality of channels based on two-channel audio signals as input signals. The audio device includes an adaptive correlation eliminating device including: a correlation eliminating filter for dividing the input signal of one of the channels by a multi-stage delay processing device, superimposing a predetermined coefficient on each of the divided multi-stage outputs by a coefficient processing device to generate multi-stage output components, and adding the multi-stage output components, thereby extracting signal components having a high correlation with the input signal of another of the channels from components of the input signal of the one of the channels; and a coefficient updating processing device for constantly varying characteristics of the correlation eliminating filter based on an error signal obtained with use of the output signal of the correlation eliminating filter and the input signal of the another of the channels, the input signal of the one of the channels, and a step size parameter for controlling an update rate for a filter coefficient. The audio device calculates a difference between the output of the correlation eliminating filter and the input signal of the another of the channels to output the difference as the surround signal (see, for example, Patent Literature 3).

CITATION LIST

Patent Literature

[PTL 1] JP 57-7000 A
[PTL 2] JP 5-236599 A
[PTL 3] JP 3682032 B

SUMMARY OF INVENTION

Technical Problem

However, in the related-art surround component generation devices, there has been a problem in that a large amount of calculation is required for the calculation of the correlation coefficient and the like in order to generate the surround component, and hence a system scale becomes large and, in other cases, a large amount of arithmetic operation is required.

The present invention has been made in order to solve the related-art problem, and has an object to provide a surround component generation device capable of generating a surround component with a small amount of arithmetic operation.

Solution to Problem

The surround component generation device according to one embodiment of the present invention includes: multipliers for changing amplitudes of two-channel audio signals; and coefficient updaters for updating coefficients of the multipliers based on a difference between the audio signals. With this configuration, it is possible to generate the surround component in accordance with the coefficient of the multiplier.

Advantageous Effects of Invention

According to one embodiment of the present invention, it is possible to provide the surround component generation device capable of generating the surround component with a small amount of arithmetic operation by generating the surround component in accordance with the updated coefficient of the multiplier.

DESCRIPTION OF EMBODIMENTS

First Embodiment

Now, a description is given of a surround component generation device according to a first embodiment of the present invention with reference to the drawings.

Figure 1:
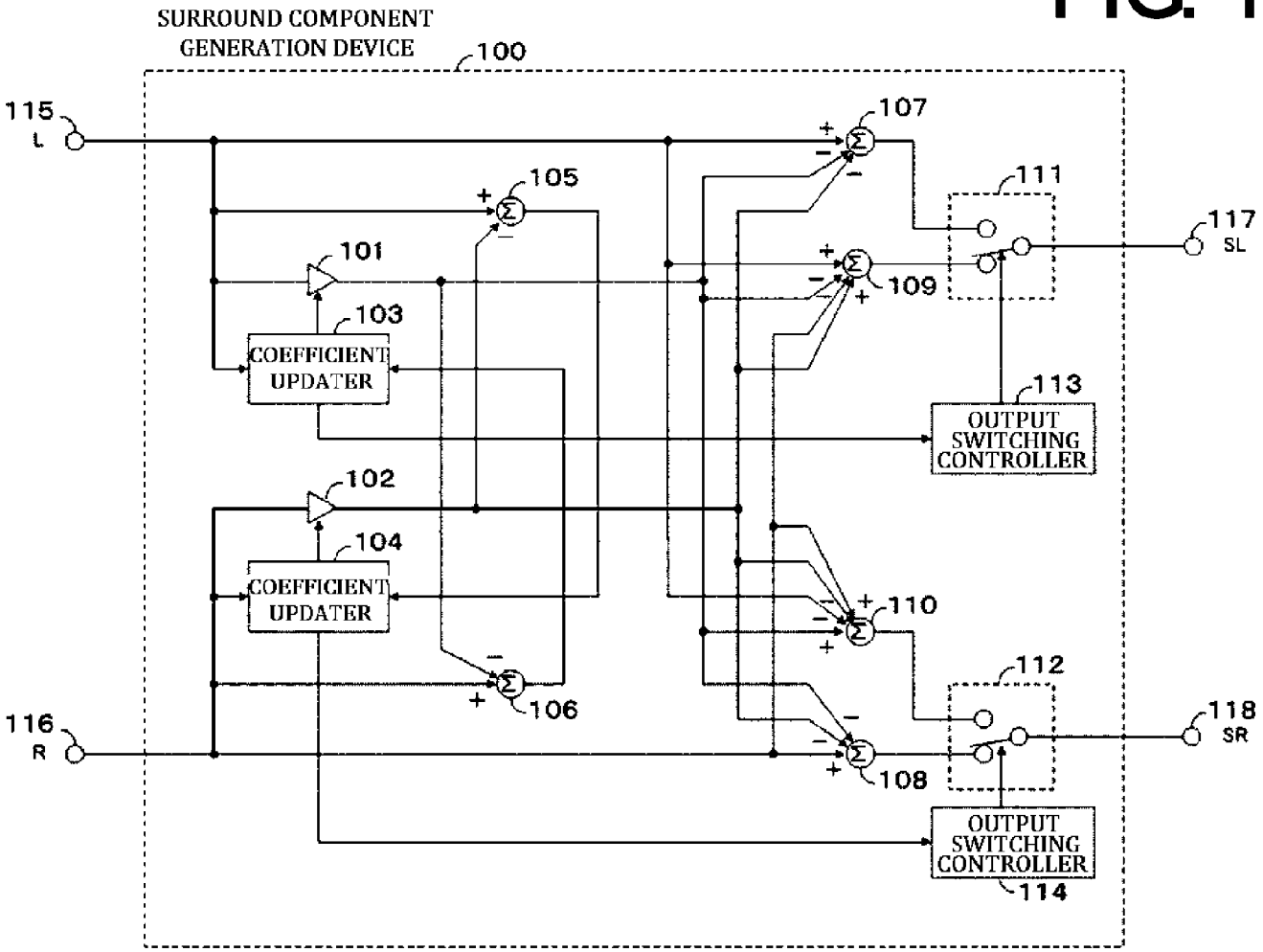
FIG. 1 is a block diagram of a surround component generation device according to a first embodiment of the present invention.

FIG. 1 illustrates the surround component generation device according to the first embodiment of the present invention.

In FIG. 1, the surround component generation device, which is denoted by 100, is connected to an audio signal generation device (not shown), such as a CD, at input terminals 115 and 116. The surround component generation device 100 is also connected to amplifiers and speakers (not shown) at output terminals 117 and 118.

The surround component generation device 100 includes multipliers 101 and 102, coefficient updaters 103 and 104 for updating coefficients of the multipliers 101 and 102, subtractors 105 and 106 for calculating differences between input signals and output signals of the multipliers 101 and 102, subtractors 107, 108, 109, and 110 for calculating output signals based on the input signals and the output signals of the multipliers 101 and 102, output switches 111 and 112 for selecting signals to be output from among the output signals of the subtractors 107, 108, 109, and 110, and output switching controllers 113 and 114 for controlling the output switches 111 and 112.

The surround component generation device 100 may be realized with use of a digital signal processor (DSP), a microcomputer, or the like capable of digital signal processing.

Referring to FIG. 1, a description is given of an operation of the surround component generation device configured as described above.

First, from the audio signal generation device (not shown), such as a CD, an Lch signal of an audio signal is input to the input terminal 115 and an Rch signal thereof is input to the input terminal 116. An operation of the surround component generation device 100 relating to the Lch signal and an operation thereof relating to the Rch signal are the same, and hence the operation relating to the Lch signal is described.

The Lch signal input to the input terminal 115 has its amplitude changed by the multiplier 101. The signal whose amplitude is changed by the multiplier 101 is to be inputs of the subtractor 106 and the subtractors 107, 108, 109, and 110.

The other input of the subtractor 106 is the Rch signal input from the input terminal 116. The subtractor 106 subtracts the output signal of the multiplier 101 from the Rch signal and outputs the resultant signal.

The output signal of the subtractor 106 is to be one input of the coefficient updater 103. The other input of the coefficient updater 103 is the Lch signal input to the input terminal 115.

The coefficient updater 103 calculates the coefficient of the multiplier 101 based on the Lch signal and the output signal of the subtractor 106 and updates the coefficient of the multiplier 101.

A description is given below of a method of updating the coefficient of the multiplier 101 by the coefficient updater 103 and a coefficient calculation result obtained by the coefficient updater 103. The coefficient updater 103 updates the coefficient of the multiplier 101 by using, for example, the following expression. It is assumed that the input signal is a digital signal.

$$k(n+1)=k(n)+\alpha(XR-k(n)\cdot XL)XL$$

In this expression, k(n+1) represents a coefficient of the multiplier 101 at the next time (when the next sample signal is input), k(n) represents a current coefficient of the multiplier 101, XL represents the Lch signal input to the input terminal 115, XR represents the Rch signal input to the input terminal 116, and a represents a constant for determining a coefficient update rate.

Moreover, (XR−k(n)·XL) is the output signal of the subtractor 106. The above-mentioned expression is an expression for sequentially updating the coefficient k of the multiplier 101 in order to minimize a square value of the output signal of the subtractor 106. When a correlation between XL and XR is high, as the coefficient k of the multiplier 101 becomes closer to 1, the square value of the output signal (XR−k·XL) of the subtractor 106 becomes smaller. When the correlation between XL and XR is low, as the coefficient k becomes closer to 0, the square value of the output signal of the subtractor 106 becomes smaller. In other words, depending on how the correlation between XL and XR is high or low, the coefficient k assumes the value of from approximately 0 to 1.

FIG. 5 each show an example of the value of k, which is calculated based on the above-mentioned expression by changing the correlation value between the input signals XL and XR.

Figure 5A:
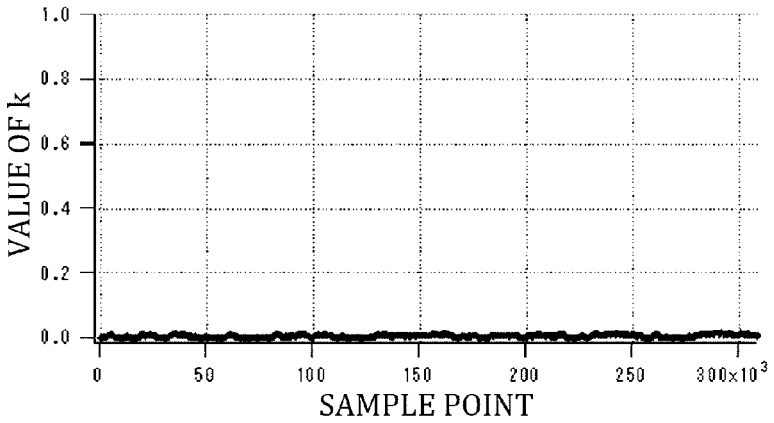
FIG. 5A is a graph showing a change of a coefficient of a multiplier obtained when signals having a low correlation are input in the surround component generation device according to the present invention.

FIG. 5A shows a result obtained when the correlation between XL and XR is low. As can be understood from FIG. 5A, the calculated value of k is approximately 0.

Figure 5B:
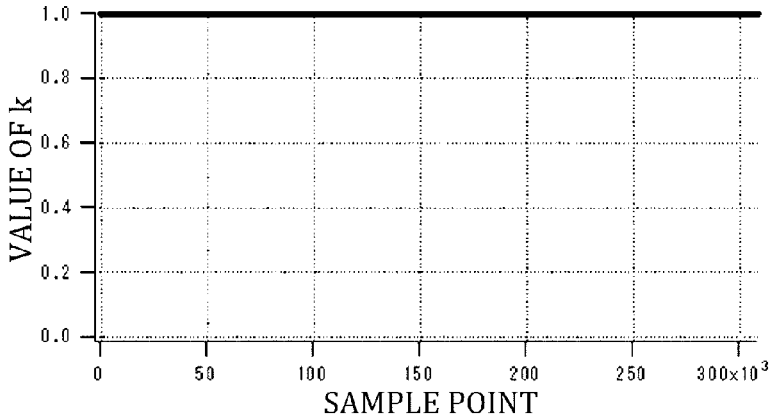
FIG. 5B is a graph showing a change of the coefficient of the multiplier obtained when signals having a high correlation are input in the surround component generation device according to the present invention.
Figure 5C:
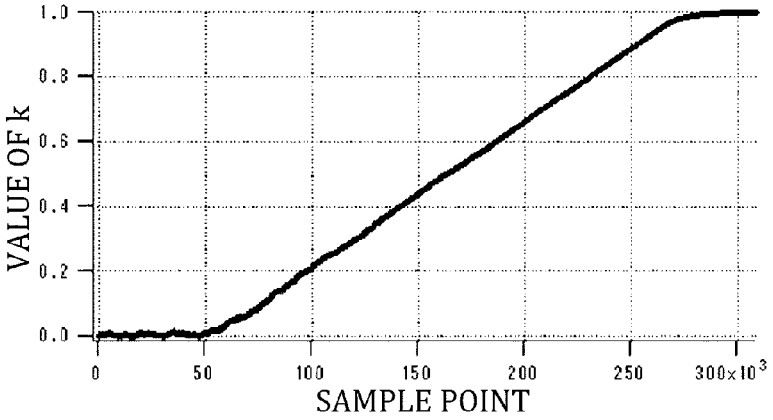
FIG. 5C is a graph showing a change of the coefficient of the multiplier obtained when signals whose correlation changes are input in the surround component generation device according to the present invention.

FIG. 5B shows a result obtained when the correlation between XL and XR is high. Similarly, the calculated value of k is approximately 1. FIG. 5C shows a result obtained when the correlation between XL and XR is changed from a high one to a low one. In this case, the value of k changes from approximately 0 to approximately 1.

As described above, when the coefficient updater 103 updates the coefficient with use of the above-mentioned expression, the coefficient k of the multiplier 101 can be changed in accordance with the correlation between the input signals XL and XR.

The subtractor 107 subtracts, from the Lch signal input to the input terminal 115, the output signal of the multiplier 101 and the output signal of the multiplier 102.

The subtractor 109 subtracts, from a signal obtained by adding the Lch signal input to the input terminal 115 and the output signal of the multiplier 102, the Rch signal input to the input terminal 116 and the output signal of the multiplier 101.

When the Lch signal input to the input terminal 115 is represented by XL, the Rch signal input to the input terminal 116 is represented by XR, and the coefficient of each of the multipliers 101 and 102 is represented by k, a signal SL1 calculated by the subtractor 107 is as follows.

$$SL1=(1-k)XL-kXR$$

Moreover, a signal SL2 calculated by the subtractor 109 is, similarly, as follows.

$$SL2=(1-k)XL-(1-k)XR$$

The output switch 111 selects one of the output signals of the subtractors 107 and 109 and outputs the selected one to the output terminal 117. The output switch 111 is controlled by the output switching controller 113.

The output switching controller 113 inputs the value of the coefficient of the multiplier 101 updated by the coefficient updater 103 and, depending on the value of the coefficient, notifies the output switch 111 of one of the output signals of the subtractors 107 and 108 to be output.

The control of the output switching controller 113 is performed as follows.

The control is performed so that the output signal (SL1) of the subtractor 107 is selected when k is smaller than 0.5, which is a predetermined value, and the output signal (SL2) of the subtractor 109 is selected when k is larger than 0.5, which is the predetermined value.

Accordingly, when the correlation between XL and XR is low, for example, when k=0, XL is output (k=0 is substituted into the above-mentioned expression for SL1). Meanwhile, when the correlation between XL and XR is high, for example, when k=1, the output signal is 0 (k=1 is substituted into the above-mentioned expression for SL2).

In this manner, such control can be performed that the surround component is output when the correlation between XL and XR is low and the surround component is inhibited from being output when the correlation between XL and XR is high. The surround component is inhibited from being output when the correlation is high because, for example, when sounds having the same component are input to Lch and Rch as the input signals (monaural sound), an unnatural sound may be produced if the surround component is added to the sound.

The above-mentioned expression for SL2 is used when the correlation between XL and XR is high because when the value of k becomes closer to 1, SL2 can be controlled to assume a small value without fail. If the expression for SL2 is $$SL2=XL-kXR,$$

SL2 is (XL−XR) when k=1, and the output of SL2 becomes 0 when XL=XR.

However, in the case of the audio signal, a reverberation component and the like are recorded in a monaural vocal component in some cases with the correlation between Lch and Rch being low, and in such cases, only the reverberation component may unnaturally be output from SL2.

In order to prevent such case from occurring, when the correlation between XL and XR is low, the above-mentioned expression for SL2 is used to calculate the output signal and the output signal is switched from one to another based on the value of k, which is a value determined depending on the correlation between XL and XR.

The output signal is switched from one to another based on whether the coefficient k is larger than "0.5" as the predetermined value because the range that the coefficient k can assume is from 0 to 1 as described above and 0.5 is a median of the range, and because when the coefficient k is 0.5, the above-mentioned values of SL1 and SL2 are the same and the output signal can thus be switched from one to another in an acoustically smooth manner.

In this embodiment, a description has been given assuming that the output signal is switched from one to another when the coefficient k is 0.5, but the value of the coefficient k (predetermined value) may be set as appropriate as long as the value of the coefficient k falls within such a range that the output signal can be switched from one to another in an acoustically smooth manner.

The signal output to the output terminal 117 is amplified by the amplifier (not shown) connected to the output terminal 117 and output as a sound by the speaker (not shown). Instead of the amplifier and speaker, a recording device, such as a hard disk recorder, may be connected to the output terminal 117.

When the surround component generation device 100 is used to generate 5.1-ch audio signals based on the two-channel audio signals, the output signals of the surround component generation device 100 may be used as surround L (SL) and surround R (SR) signals, the input two-channel signals (L and R) may be output as they are as a front L (FL) signal and a front R (FR) signal, and a center (CT) signal and a woofer (WF) output may be generated separately based on the input two-channel signals.

For example, when the (L+R) signal is output as the CT signal and the (L+R) signal subjected to a low pass filter (LPF) is output as the WF signal, it is possible to generate the CT and WF signals.

According to the surround component generation device of the first embodiment of the present invention described above, which includes the multipliers for changing the amplitudes of the 2-channel audio signals, the coefficient updaters for updating the coefficients of the multipliers based on the difference between the audio signals, the plurality of subtractors for generating the surround components based on the audio signals and the output signals of the multipliers, the output switches for selecting the surround output signals from among the outputs of the plurality of subtractors, and the output switching controllers for controlling the output switches, it is possible to calculate the value related to the correlation between the channels of the audio signals with a small amount of arithmetic operation by updating the coefficient of the multiplier, and by switching the output switch based on the coefficient of the multiplier, it is also possible to output the surround component when the correlation between the channels of the audio signals is low and inhibit the surround component from being output when the correlation is high.

Second Embodiment

Figure 2:
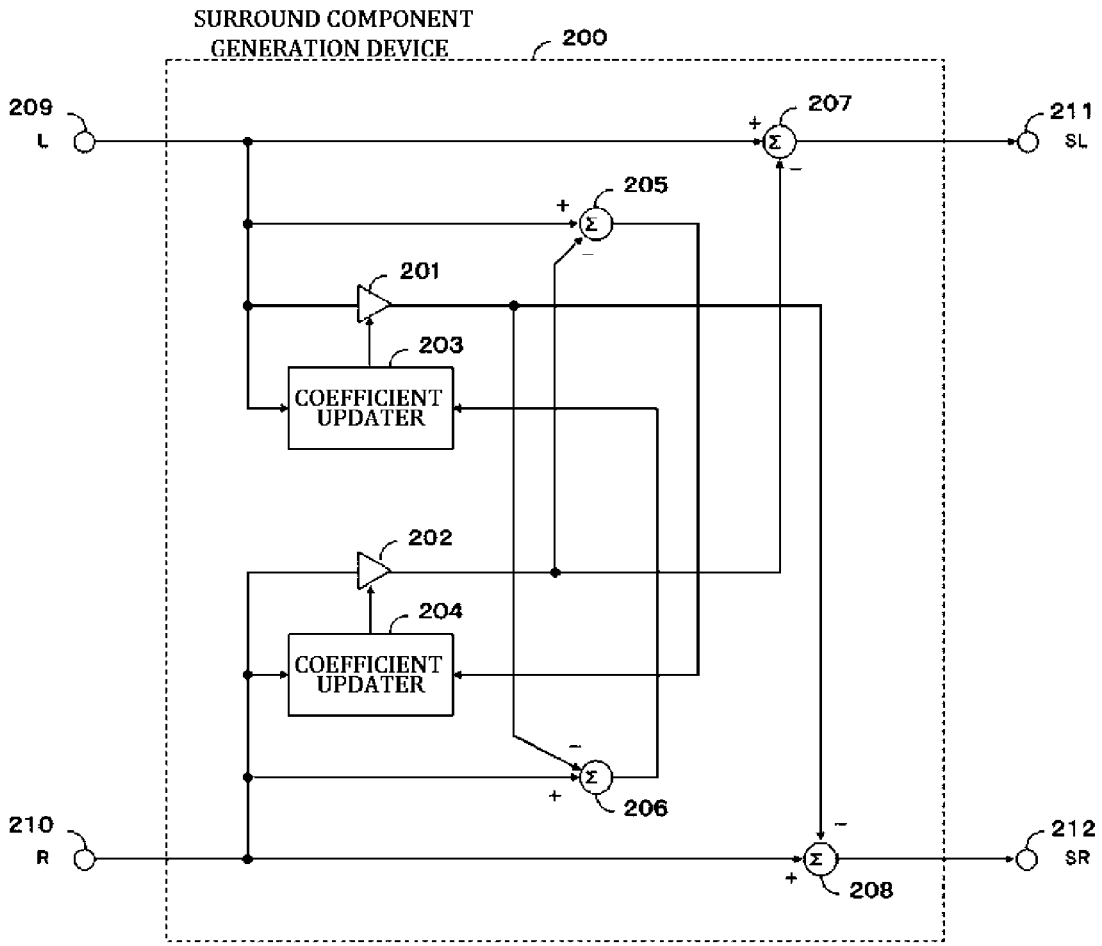
FIG. 2 is a block diagram of a surround component generation device according to a second embodiment of the present invention.

Next, FIG. 2 illustrates a surround component generation device according to a second embodiment of the present invention.

In FIG. 2, the surround component generation device, which is denoted by 200, includes multipliers 201 and 202, coefficient updaters 203 and 204 for updating coefficients of the multipliers 201 and 202, subtractors 205 and 206 for calculating differences between input signals and output signals of the multipliers 201 and 202, a subtractor 207 for calculating a difference between the input signal input from an input terminal 209 and an output signal of the multiplier 202, and a subtractor 208 for calculating a difference between the signal input from an input terminal 210 and an output signal of the multiplier 201.

Operations of the multipliers 201 and 202, the coefficient updaters 203 and 204, and the subtractors 205 and 206 are the same as those of the surround component generation device of the first embodiment described above.

The subtractor 207 subtracts the output of the multiplier 202 from the Lch signal input to the input terminal 209. Similarly, the subtractor 208 subtracts the output of the multiplier 201 from the Rch signal input to the input terminal 210. When the Lch input signal is represented by XL, the Rch input signal is represented by XR, and the coefficient of each of the multipliers 201 and 202 is represented by k, a signal SL calculated by the subtractor 207 and a signal SR calculated by the subtractor 208 are as follows.

$$SL=XL-kXR$$

$$SR=XR-kXL$$

When the correlation between XL and XR is low (k=0), relationships of SL=XL and SR=XR are established. When the correlation between XL and XR is high (k=1), relationships of SL=XL−XR and SR=XR−XL are established.

This embodiment is effective in a case where, for example, when the correlation between XL and XR is high but the reverberation component with a low correlation is included in XL and XR, the reverberation component is generated as the surround component.

The outputs of the subtractors 207 and 208 are output to output terminals 211 and 212, respectively.

According to the surround component generation device of the second embodiment of the present invention described above, which includes the multipliers for changing the amplitudes of the 2-channel audio signals, the coefficient updaters for updating the coefficients of the multipliers based on the difference between the audio signals, and the plurality of subtractors for generating the surround components based on the audio signals and the output signals of the multipliers, it is possible to calculate the value related to the correlation between the channels of the audio signals with a small amount of arithmetic operation by updating the coefficient of the multiplier and also possible to generate the surround components in accordance with each of the coefficients of the multipliers.

Third Embodiment

Figure 3:
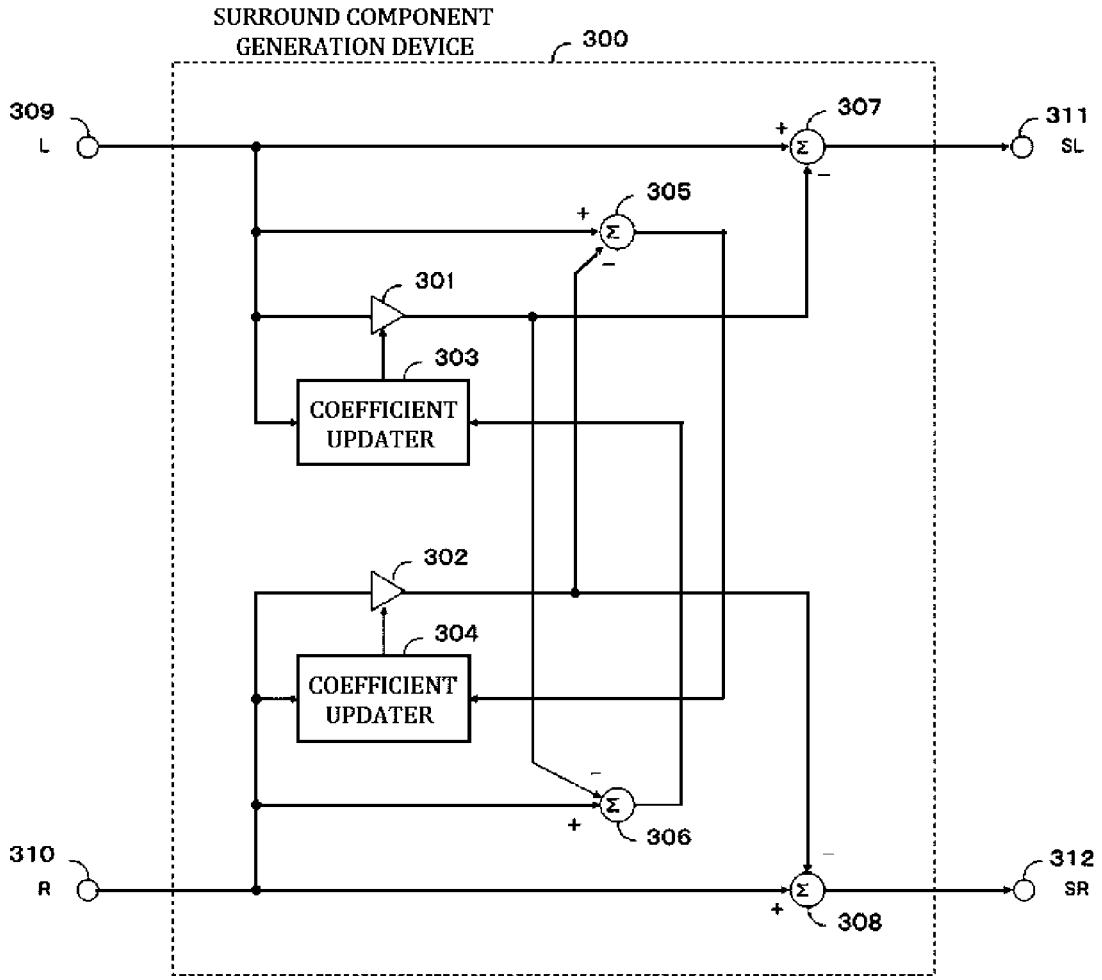
FIG. 3 is a block diagram of a surround component generation device according to a third embodiment of the present invention.

Next, FIG. 3 illustrates a surround component generation device according to a third embodiment of the present invention.

In FIG. 3, the surround component generation device, which is denoted by 300, includes multipliers 301 and 302, coefficient updaters 303 and 304 for updating coefficients of the multipliers 301 and 302, subtractors 305 and 306 for calculating differences between input signals and output signals of the multipliers 301 and 302, a subtractor 307 for calculating a difference between the input signal input from an input terminal 309 and an output signal of the multiplier 301, and a subtractor 308 for calculating a difference between the signal input from an input terminal 310 and an output signal of the multiplier 302.

Operations of the multipliers 301 and 302, the coefficient updaters 303 and 304, and the subtractors 305 and 306 are the same as those of the surround component generation device of the first embodiment described above.

The subtractor 307 subtracts the output of the multiplier 301 from the Lch signal input to the input terminal 309.

Similarly, the subtractor 308 subtracts the output of the multiplier 302 from the Rch signal input to the input terminal 310.

When the Lch input signal is represented by XL, the Rch input signal is represented by XR, and the coefficient of each of the multipliers 301 and 302 is represented by k, a signal SL calculated by the subtractor 307 and a signal SR calculated by the subtractor 308 are as follows.

$$SL=XL-kXL$$

$$SR=XR-kXR$$

When the correlation between XL and XR is low (k=0), relationships of SL=XL and SR=XR are established. When the correlation between XL and XR is high (k=1), relationships of SL=0 and SR=0 are established. The above-mentioned expressions do not include a term for (XL−XR) or (XR−XL), and hence even when, for example, an unnatural sound is produced when an arithmetic operation of (XL−XR) or (XR−XL) is performed, it is possible to generate an acoustically natural surround component.

The outputs of the subtractors 307 and 308 are output to output terminals 311 and 312, respectively.

According to the surround component generation device of the third embodiment of the present invention described above, which includes the multipliers for changing the amplitudes of the 2-channel audio signals, the coefficient updaters for updating the coefficients of the multipliers based on the difference between the audio signals, and the plurality of subtractors for generating the surround components based on the audio signals and the output signals of the multipliers, it is possible to calculate the value related to the correlation between the channels of the audio signals with a small amount of arithmetic operation by updating the coefficient of the multiplier and also possible to generate the acoustically natural surround components in accordance with each of the coefficients of the multipliers.

Fourth Embodiment

Figure 4:
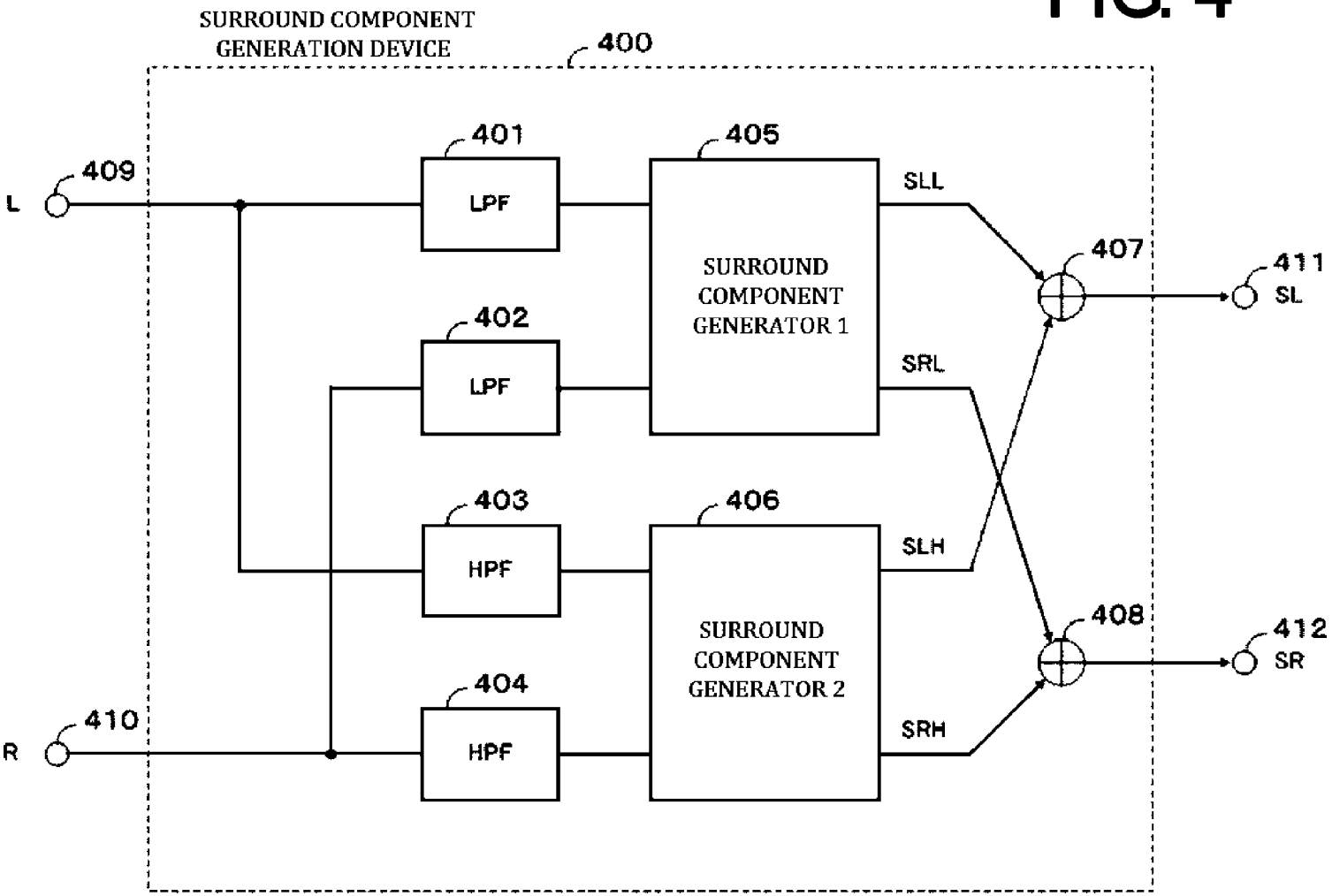
FIG. 4 is a block diagram of a surround component generation device according to a fourth embodiment of the present invention.

Next, FIG. 4 illustrates a surround component generation device according to a fourth embodiment of the present invention.

In FIG. 4, the surround component generation device, which is denoted by 400, includes LPFs 401 and 402, high pass filters (HPFs) 403 and 404, a first surround component generator 405, a second surround component generator 406, and adders 407 and 408.

Referring to FIG. 4, a description is given of an operation of the surround component generation device configured as described above.

In FIG. 4, an Lch signal from the audio signal generation device (not shown), such as a CD, is input to an input terminal 409 and an Rch signal from the audio signal generation device is input to an input terminal 410. The Lch signal input to the input terminal 409 has its low-frequency component extracted by the LPF 401 and has its high-frequency component extracted by the HPF 403. Similarly, the Rch signal input to the input terminal 410 has its low-frequency component extracted by the LPF 402 and has its high-frequency component extracted by the HPF 404. Output signals of the LPFs 401 and 402 are input to the first surround component generator 405.

Similarly, output signals of the HPFs 403 and 404 are input to the second surround component generator 406. Types of filters of the LPFs 401 and 402 and the HPFs 403 and 404 and cutoff frequencies (fc) thereof are selected so that a signal obtained by adding the input signal subjected to the LPF and the input signal subjected to the HPF is the original input signal.

For example, when a first-order Butterworth filter is used to use the same fc in the LPFs and the HPFs, the signals obtained after the addition are the signals before being passed through the filters.

Any one of the surround component generation devices of the first to third embodiments of the present invention is used as each of the first surround component generator 405 and the second surround component generator 406. The surround component generation methods of the first surround component generator 405 and the second surround component generator 406 may be the same or differ from each other.

An Lch surround component (SLL: Surround L-Low) for a low frequency band generated by the first surround component generator 405 is to be one of inputs to the adder 407. Similarly, an Rch surround component (SRL: Surround R-Low) for a low frequency band generated by the first surround component generator 405 is to be one of inputs to the adder 408.

Further, an Lch surround component (SLH: Surround L-High) for a high frequency band generated by the second surround component generator 406 is to be another of the inputs to the adder 407.

Similarly, an Rch surround component (SRH: Surround R-High) for a high frequency band generated by the second surround component generator 406 is to be another of the inputs to the adder 408.

The adder 407 adds SLL to SLH and the adder 408 adds SRL to SRH so that the resultant signals are the surround components of Lch and Rch, respectively. Outputs of the adders 407 and 408 are output to output terminals 411 and 412, respectively.

The input signals are each divided into signals having different frequency bands in this manner to perform surround component generation processing because the audio signal often has a correlation different for each frequency band.

In view of this, each of the coefficients of the multipliers updated within the first surround component generator 405 or the second surround component generator 406 is a value different for each frequency band, and hence it is possible to generate the surround component in accordance with a value closer to an actual correlation value of the audio signals.

Further, for example, in audio signals, an in-phase bass sound may be recorded in the two-channel audio signals in a low frequency band, and in a high frequency band, sounds of musical instruments that are different between left and right audio signals may be recorded.

When the audio signal is divided into signals having different frequency bands to generate the surround components, it is possible to generate the surround components utilizing such characteristics of the audio signal, and it is thus possible to generate more acoustically natural surround components.

According to the surround component generation device of the fourth embodiment of the present invention described above, which includes the filters for dividing the two-channel audio signals into the signals having the plurality of frequency bands, the surround component generators for updating the coefficients of the multipliers for each of the frequency bands and generating the surround components in accordance with each of the coefficients of the multipliers, and the adders for adding the surround components for each frequency band, it is possible to calculate the value related to the correlation between the channels of the audio signals with a small amount of arithmetic operation by updating the coefficient of the multiplier, and it is also possible to generate acoustically natural surround components by using the surround component generation methods different for each of the divided frequency bands.

The present application is based on Japanese Patent Application No. 2012-21921, filed on Feb. 3, 2012, the contents of which are incorporated by reference herein.

INDUSTRIAL APPLICABILITY

As described above, the surround component generation device according to the present invention includes: the multipliers; and the coefficient updaters for updating the coefficients of the multipliers, and generates the surround components based on the updated coefficients of the multipliers. Thus, the surround component generation device has such an effect that it is possible to generate the surround component with a small amount of arithmetic operation, and is useful as the surround component generation device and the like for generating the surround signals for multichannel reproduction based on the two-channel audio signals.

REFERENCE SIGNS LIST

100, 200, 300, 400 surround component generation device
101, 102, 201, 202, 301, 302 multiplier
103, 104, 203, 204, 303, 304 coefficient updater
105, 106, 107, 108, 109, 110, 205, 206, 207, 208, 305, 306, 307, 308 subtractor
111, 112 output switch
113, 114 output switching controller
115, 116, 209, 210, 309, 310, 409, 410 input terminal
117, 118, 211, 212, 311, 312, 411, 412 output terminal
401, 402 LPF
403, 404 HPF
405 first surround component generator
406 second surround component generator
407, 408 adder

The invention claimed is:

1. A surround component generation device for generating a surround component based on each of two-channel audio signals of L and R signals, comprising:

at least one input terminal receiving the two-channel audio signals output from an audio signal generation device; and a control circuitry operative to:

change amplitudes of the two-channel audio signals;

update coefficients of the change of amplitudes of the two-channel audio signals based on a difference between the L and R signals; and change the surround component to be generated depending on each of the coefficients.

2. A surround component generation device according to claim 1, wherein when the each of the coefficients of the change of amplitudes of the two channel audio signals is represented by k, the surround component generation device generates the surround component by an arithmetic operation of L−kL or R−kR.

3. A surround component generation device according to claim 1, wherein when the each of the coefficients of the change of amplitudes of the two channel audio signals is represented by k, the surround component generation device generates the surround component by an arithmetic operation of L−kR or R−kL.

4. A surround component generation device according to claim 1, wherein when the each of the coefficients of the change of amplitudes of the two channel audio signals is represented by k, the surround component generation device generates, by an arithmetic operation of (1−k)L−(1−k)R or (1−k)R−

(1−k)L, the surround component to be generated when a value of k is larger than a predetermined value, and the surround component generation device generates, by an arithmetic operation of (1−k)L−kR or (1−k)R−kL, the surround component to be generated when the value of k is smaller than the predetermined value.

5. A surround component generation device according to claim 1, wherein the surround component generation device further comprises filters for dividing the two-channel audio signals into signals having a plurality of frequency bands, wherein the surround component generation device generates the surround component for each of the plurality of frequency bands divided by the filters, and the surround component generation device further comprises adders for adding the surround components generated for the each of the plurality of frequency bands.

* * * * *